US011773853B2

(12) United States Patent
Kasahara et al.

(10) Patent No.: US 11,773,853 B2
(45) Date of Patent: Oct. 3, 2023

(54) MULTI-STAGE SCREW COMPRESSOR

(71) Applicant: Hitachi Industrial Equipment Systems Co., Ltd., Tokyo (JP)

(72) Inventors: Masayuki Kasahara, Tokyo (JP); Sho Nikaido, Tokyo (JP); Yuki Ishizuka, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 153 days.

(21) Appl. No.: 17/428,864

(22) PCT Filed: Dec. 16, 2019

(86) PCT No.: PCT/JP2019/049140
§ 371 (c)(1),
(2) Date: Aug. 5, 2021

(87) PCT Pub. No.: WO2020/162046
PCT Pub. Date: Aug. 13, 2020

(65) Prior Publication Data

US 2022/0112895 A1 Apr. 14, 2022

(30) Foreign Application Priority Data

Feb. 6, 2019 (JP) ..... 2019-020005

(51) Int. Cl.
*F04C 18/16* (2006.01)
*F04C 23/00* (2006.01)
(Continued)

(52) U.S. Cl.
CPC ..... *F04C 18/16* (2013.01); *F04C 23/00* (2013.01); *F04C 29/04* (2013.01); *F04C 29/12* (2013.01)

(58) Field of Classification Search
CPC ..... F01C 21/02; F04C 18/16; F04C 18/084; F04C 23/00; F04C 23/02; F04C 23/001;
(Continued)

(56) References Cited

U.S. PATENT DOCUMENTS 3,467,300 A 9/1969 Schibbye
11,149,732 B2 * 10/2021 Akei ..... F04C 18/16
(Continued)

FOREIGN PATENT DOCUMENTS

CN 106704179 A 5/2017
CN 206636781 U 11/2017
(Continued)

OTHER PUBLICATIONS

International Search Report (PCT/ISA/210) issued in PCT Application No. PCT/JP2019/049140 dated Feb. 18, 2020 with English translation (five (5) pages).
(Continued)

*Primary Examiner* — Audrey B. Walter
*Assistant Examiner* — Dapinder Singh
(74) *Attorney, Agent, or Firm* — Crowell & Moring LLP

(57) ABSTRACT

Provided is a multi-stage screw compressor with which an intermediate shaft section of a rotor can be made shorter. A two-stage screw compressor includes a front-stage compressing mechanism 1 which has a front-stage male rotor 11A and a front-stage female rotor 11B, and which compresses air, and a rear-stage compressing mechanism 2 which has a rear-stage male rotor 12A and a rear-stage female rotor 12B, and which further compresses the air compressed by the front-stage compressing mechanism 1. The front-stage male rotor 11A and the rear-stage male rotor 12A are configured to be coaxial, and the front-stage female rotor 11B and the rear-stage female rotor 12B are configured to be coaxial. An axial delivery pocket 34 of the front-stage
(Continued)

compressing mechanism 1 and an axial intake pocket 39 of the rear-stage compressing mechanism 2 are arranged in a positional relation of partly overlapping with each other in the axial direction of the rotor, and are separated from each other by a separating wall 41.

4 Claims, 7 Drawing Sheets

(51) Int. Cl.
*F04C 29/04* (2006.01)
*F04C 29/12* (2006.01)

(58) Field of Classification Search
CPC ..... F04C 28/02; F04C 29/04; F04C 29/12; F04C 2240/20; F04C 2240/51; F04C 2240/52; F04C 2240/60
See application file for complete search history.

(56) References Cited

U.S. PATENT DOCUMENTS 11,286,933 B2 * 3/2022 Cao ..... F04C 29/0007
2002/0081213 A1 * 6/2002 Takahashi ..... F04C 23/00 417/313
2017/0268498 A1 9/2017 Kasahara
2018/0119601 A1 * 5/2018 Lin ..... F04C 18/16

FOREIGN PATENT DOCUMENTS

JP 62-168987 A 7/1987
JP 62-183091 U 11/1987
JP 63-36086 A 2/1988
JP 2017-166401 A 9/2017

OTHER PUBLICATIONS

Japanese-language Written Opinion (PCT/ISA/237) issued in PCT Application No. PCT/JP2019/049140 dated Feb. 18, 2020 (three (3) pages).
Extended European Search Report issued in European Application No. 19914237.3 dated Oct. 10, 2022 (seven (7) pages).
International Preliminary Report on Patentability (PCT/IB/338 & PCT/IB/373) issued in PCT Application No. PCT/JP2019/049140 dated Aug. 19, 2021, Including English translation of document (Japanese-language Written Opinion (PCT/ISA/237), filed on Aug. 5, 2021) (eight (8) pages).

* cited by examiner

MULTI-STAGE SCREW COMPRESSOR

TECHNICAL FIELD

The present invention relates to a multi-stage screw compressor.

BACKGROUND ART

A two-stage screw compressor described in Patent Document 1 includes a front-stage (low pressure stage) compressing mechanism that compresses a gas, an intercooler that cools the compressed gas delivered from the front-stage compressing mechanism, and a rear-stage (high pressure stage) compressing mechanism that further compresses the compressed gas cooled by the intercooler. By cooling the compressed gas by the intercooler, compression efficiency can be enhanced.

The front-stage compressing mechanism has a front-stage male rotor and a front-stage female rotor that mesh with each other, and compresses a gas by front-stage operating chambers formed at tooth grooves of the male and female rotors. The rear-stage compressing mechanism has a rear-stage male rotor and a rear-stage female rotor that mesh with each other, and further compresses the compressed gas by rear-stage operating chambers formed at tooth grooves of the male and female rotors.

PRIOR ART DOCUMENT

Patent Document

Patent Document 1: JP-2017-166401-A

SUMMARY OF THE INVENTION

Problem to be Solved by the Invention

In the aforementioned two-stage screw compressor, configuring the front-stage male rotor and the rear-stage male rotor to be coaxial (specifically, connecting the tooth section of the front-stage male rotor with the tooth section of the rear-stage male rotor at an intermediate shaft section) and configuring the front-stage female rotor and the rear-stage female rotor to be coaxial (specifically, connecting the tooth section of the front-stage female rotor with the tooth section of the rear-stage female rotor at an intermediate shaft section) are contemplated. In this case, a bearing for supporting the intermediate shaft section between the tooth section of the front-stage male rotor and the tooth section of the rear-stage male rotor may be eliminated, and a bearing for supporting the intermediate shaft section between the tooth section of the front-stage female rotor and the tooth section of the rear-stage female rotor may be eliminated, whereby bearing loss (mechanical loss) can be reduced. However, since the distance between the bearings becomes longer, there is a fear of increases in sag and vibration of the rotors. In addition, the intermediate shaft section of the rotors is smaller in diameter than the tooth sections, and is susceptible to bending deformation. Therefore, it is desired to make the intermediate shaft section of the rotor shorter.

The present invention has been made in consideration of the above-mentioned circumstances. It is an object of the present invention to make shorter the intermediate shaft section of the rotor.

Means for Solving the Problem

In order to solve the aforementioned problem, the configuration described in the claims is applied. While the present invention includes a plurality of means for solving the above problem, one example of the means is a multi-stage screw compressor including: a front-stage compressing mechanism that has a front-stage male rotor having a tooth section and a front-stage female rotor having a tooth section, the tooth sections meshing with each other, and a front-stage bore accommodating the tooth section of the front-stage male rotor and the tooth section of the front-stage female rotor and forming front-stage operating chambers at tooth grooves of the tooth sections, the front-stage compressing mechanism compressing a gas by the front-stage operating chambers; and a rear-stage compressing mechanism that has a rear-stage male rotor having a tooth section and a rear-stage female rotor having a tooth section, the tooth sections meshing with each other, and a rear-stage bore accommodating the tooth section of the rear-stage male rotor and the tooth section of the rear-stage female rotor and forming rear-stage operating chambers at tooth grooves of the tooth sections, the rear-stage compressing mechanism further compressing by the rear-stage operating chambers the gas compressed by the front-stage compressing mechanism, the front-stage male rotor and the rear-stage male rotor being configured to be coaxial, and rotatably supported by only a plurality of bearings that are not disposed between the tooth sections of the front-stage male rotor and the rear-stage male rotor but are disposed on both outer sides of the tooth sections, the front-stage female rotor and the rear-stage female rotor being configured to be coaxial, and rotatably supported by only a plurality of bearings that are not disposed between the tooth sections of the front-stage female rotor and the rear-stage female rotor but are disposed on both outer sides of the tooth sections, in which the front-stage compressing mechanism has an axial delivery pocket that is a part of a front-stage delivery flow line for delivering the compressed gas from the front-stage operating chambers, is located so as to overlap with the front-stage bore as viewed in a rotor axial direction and is a flow line communicating with the front-stage operating chambers in the rotor axial direction, the rear-stage compressing mechanism has an axial intake pocket that is a part of a rear-stage intake flow line for taking in the compressed gas into the rear-stage operating chambers, is located so as to overlap with the rear-stage bore as viewed in the rotor axial direction and is a flow line communicating with the rear-stage operating chambers in the rotor axial direction, and the axial delivery pocket of the front-stage compressing mechanism and the axial intake pocket of the rear-stage compressing mechanism are disposed in a positional relation of partly overlapping with each other in the rotor axial direction and are separated from each other by a separating wall.

Advantages of the Invention

According to the present invention, the axial delivery pocket of the front-stage compressing mechanism and the axial intake pocket of the rear-stage compressing mechanism are arranged in the positional relation of partly overlapping with each other in the rotor axial direction, and, therefore, the intermediate shaft section of the rotor can be made shorter, as compared to the case where the pockets are arranged in the positional relation of not overlapping with each other in the rotor axial direction.

Note that the other problems, configurations and effects than the above-mentioned will be made clear by the following description.

MODES FOR CARRYING OUT THE INVENTION

Figure 4:
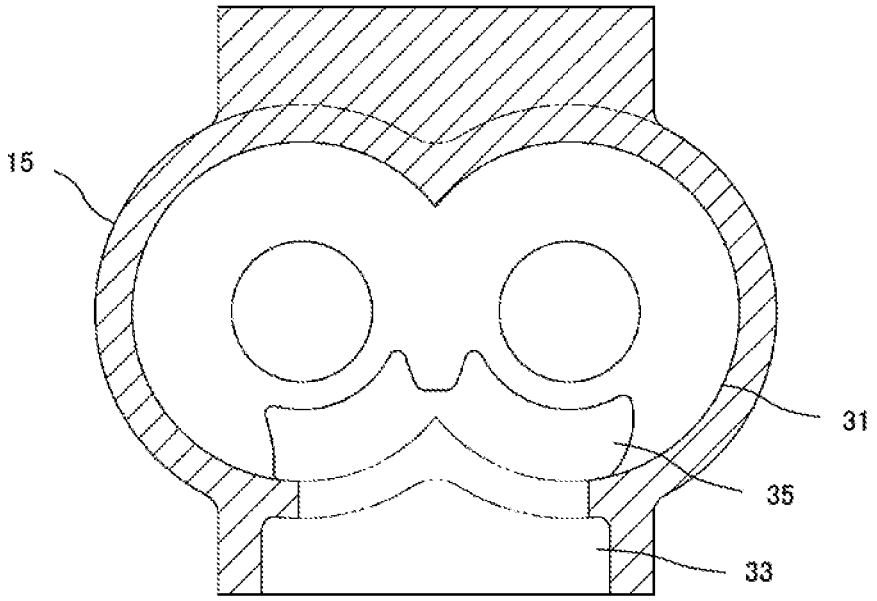
FIG. 4 is a radial sectional view taken along section IV-IV of FIG. 3.
Figure 5:
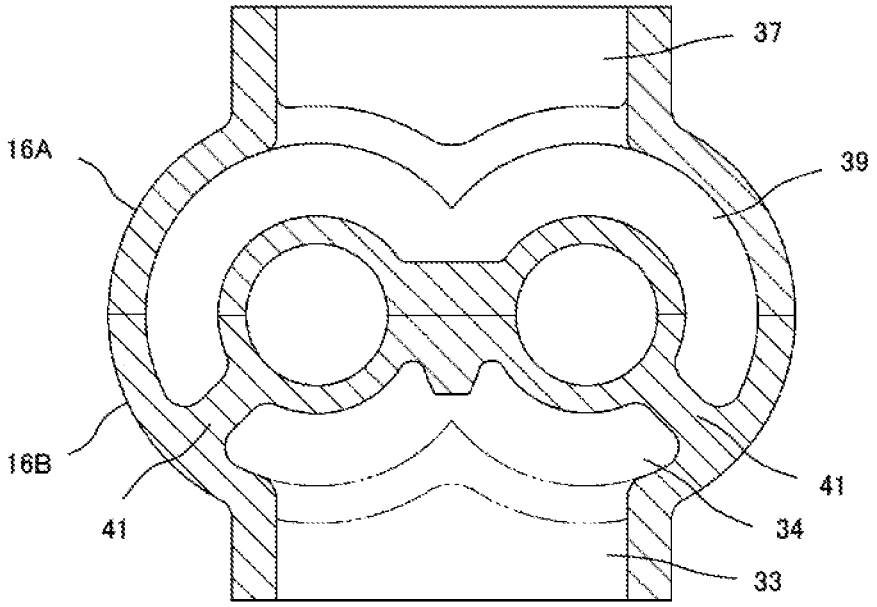
FIG. 5 is a radial sectional view taken along section V-V of FIG. 3.
Figure 6:
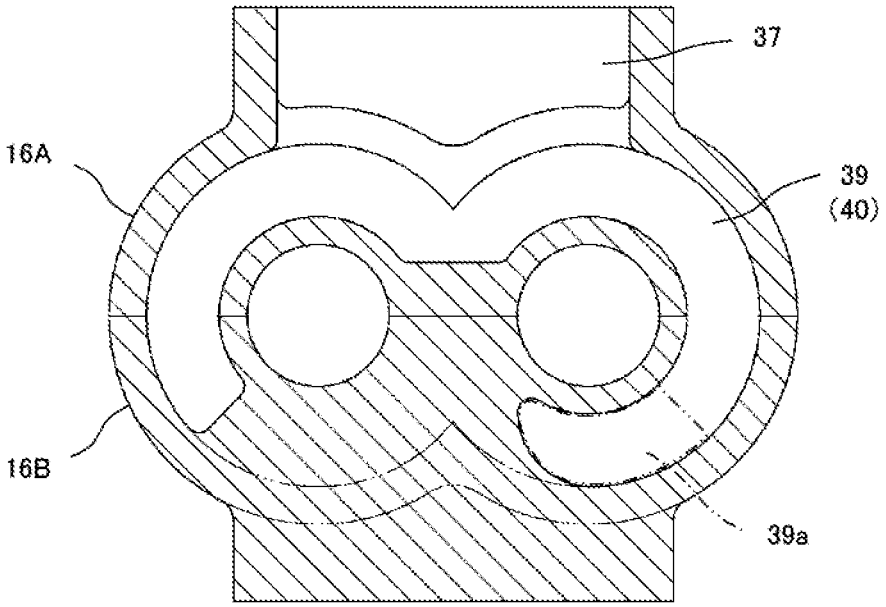
FIG. 6 is a radial sectional view taken along section VI-VI of FIG. 3.

An oilless two-stage screw compressor will be described as an example of an embodiment of the present invention, referring to FIGS. 1 to 6. Note that in FIGS. 4 to 6, illustration of rotors is omitted for convenience' sake.

Figure 1:
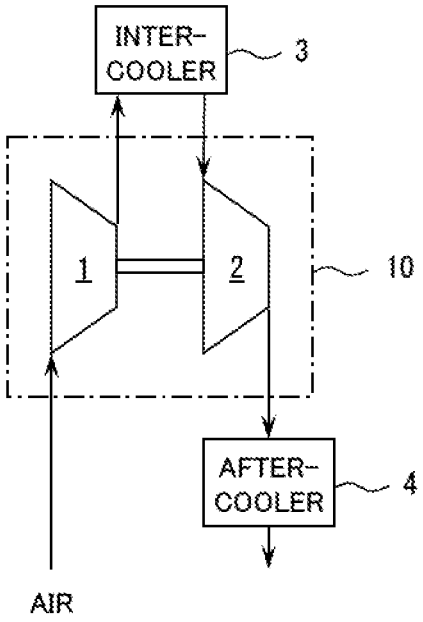
FIG. 1 is a schematic diagram depicting the configuration of a two-stage screw compressor according to an embodiment of the present invention.

As depicted in FIG. 1, the two-stage screw compressor of the present embodiment includes a front-stage (low pressure stage) compressing mechanism 1 that compresses air (a gas), an intercooler 3 that cools the compressed air (compressed gas) delivered from the front-stage compressing mechanism 1, a rear-stage (high pressure stage) compressing mechanism 2 that further compresses the compressed air cooled by the intercooler 3, and an aftercooler 4 that cools the compressed air delivered from the rear-stage compressing mechanism 2. The front-stage compressing mechanism 1 and the rear-stage compressing mechanism 2 are integrally configured as a compressor main body 10.

Figure 2:
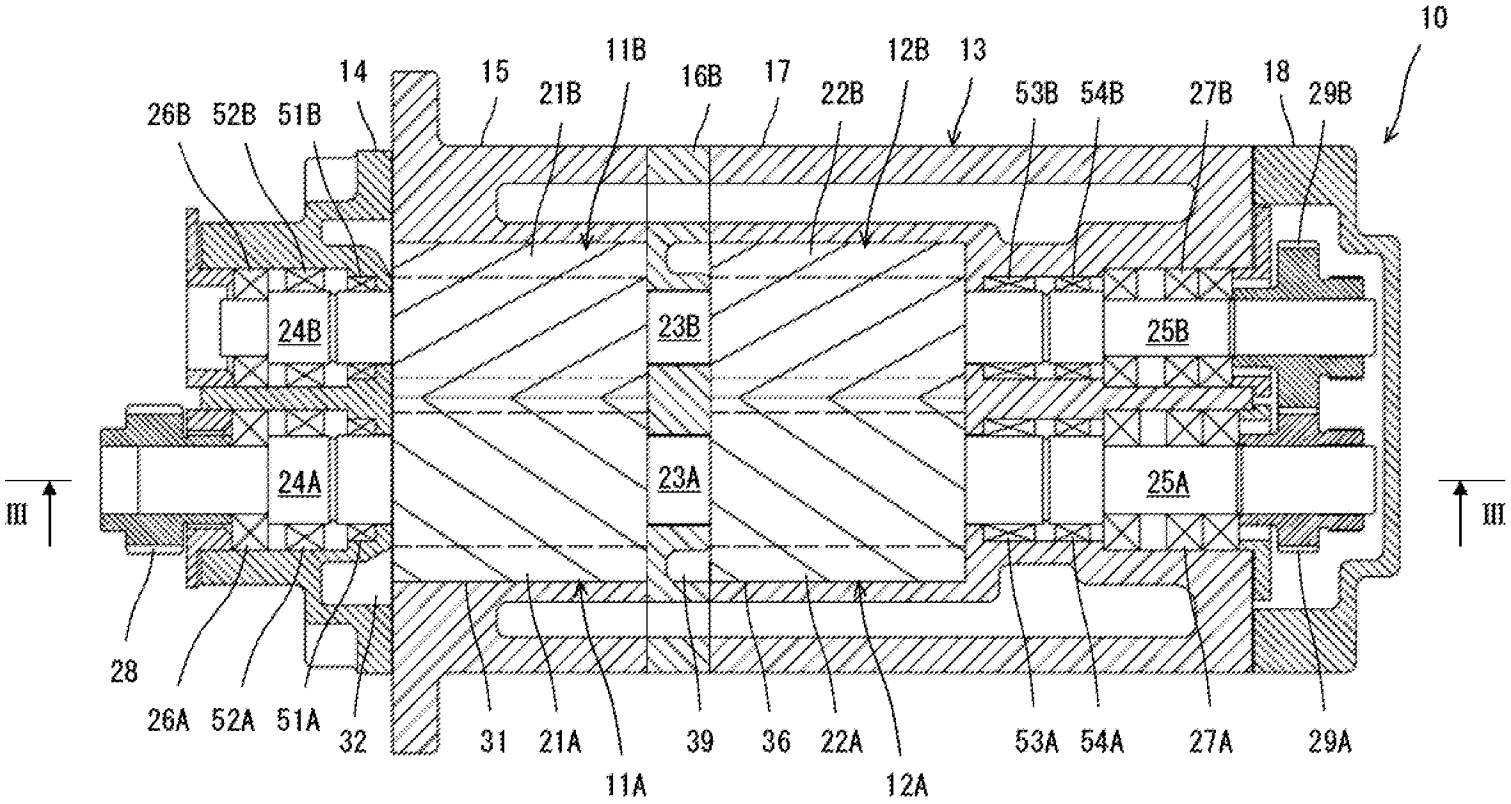
FIG. 2 is a horizontal sectional view depicting the structure of a major part of the two-stage screw compressor according to the embodiment of the present invention.
Figure 3:
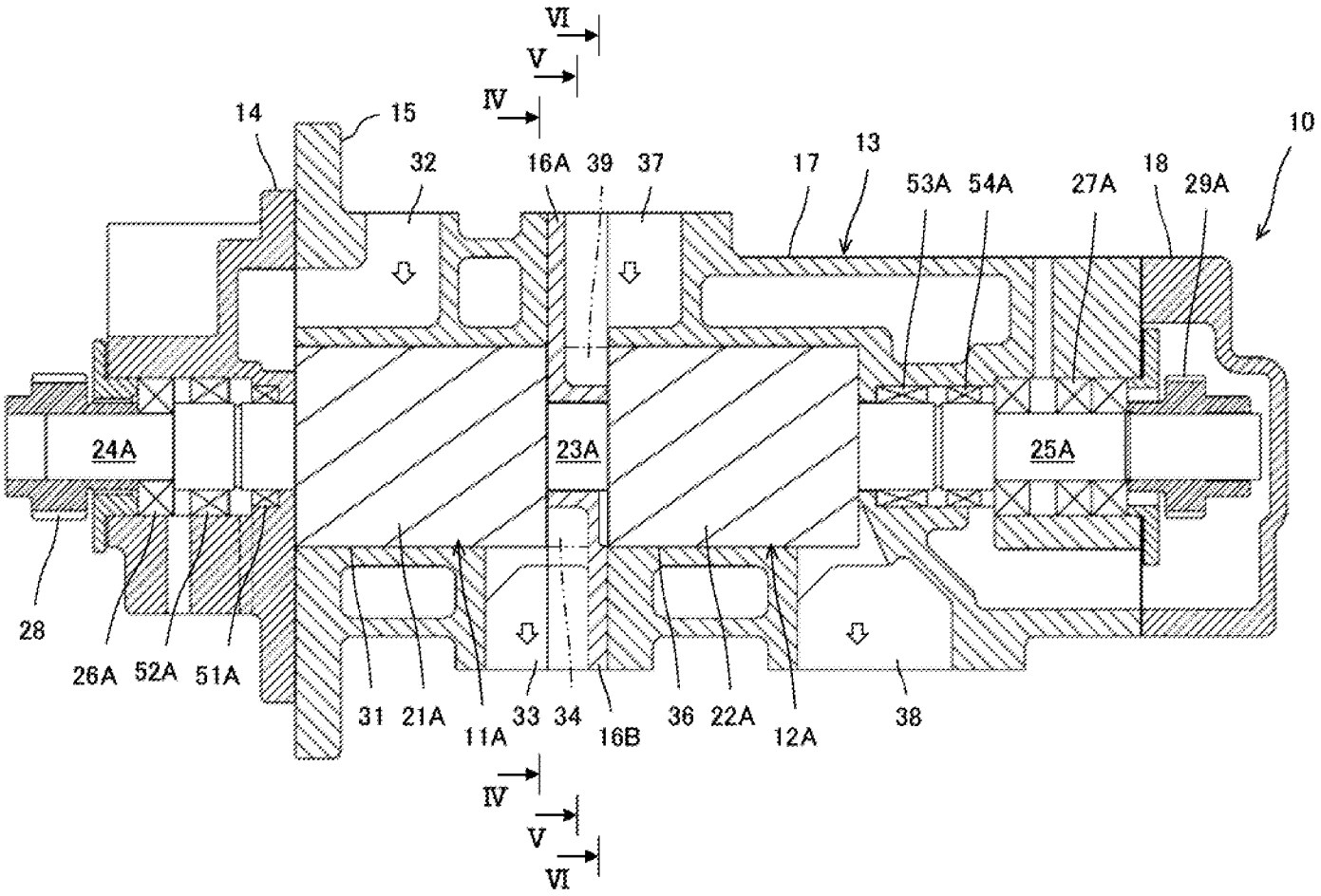
FIG. 3 is a vertical sectional view taken alone section III-III of FIG. 2.

As illustrated in FIGS. 2 and 3, the compressor main body 10 includes a front-stage male rotor 11A and a front-stage female rotor 11B of the front-stage compressing mechanism 1, a rear-stage male rotor 12A and a rear-stage female rotor 12B of the rear-stage compressing mechanism 2, and a casing 13 accommodating these components. The casing 13 includes a front-stage intake-side casing 14, a front-stage main casing 15, intermediate casings 16A and 16B, a rear-stage main casing 17, and an end cover 18 which are partitioned in the rotor axial direction (the left-right direction in FIGS. 2 and 3). The intermediate casings 16A and 16B are partitioned in the vertical direction.

The front-stage male rotor 11A and the rear-stage male rotor 12A are configured to be coaxial. More specifically, a tooth section 21A of the front-stage male rotor 11A has a plurality of (for example, five) teeth extending spirally, and a tooth section 22A of the rear-stage male rotor 12A has a plurality of (for example, five) teeth extending spirally. In the present embodiment, the tooth sections 21A and 22A are the same in tooth shape and radial size in a radial section. An intermediate shaft section 23A is connected between the tooth section 21A of the front-stage male rotor 11A and the tooth section 22A of the rear-stage male rotor 12A, an outside shaft section 24A is connected to an outer side (the left side in FIGS. 2 and 3) of the tooth section 21A, and an outside shaft 25A is connected to an outer side (the right side in FIGS. 2 and 3) of the tooth section 22A. The front-stage male rotor 11A and the rear-stage male rotor 12A are rotatably supported by only a plurality of bearings 26A and 27A which are not disposed between the tooth sections 21A and 22A but are disposed on both outer sides of the tooth sections 21A and 22A.

Similarly, the front-stage female rotor 11B and the rear-stage female rotor 12B are configured to be coaxial. More specifically, a tooth section 21B of the front-stage female rotor 11B has a plurality of (for example, seven) teeth extending spirally, and a tooth section 22B of the rear-stage female rotor 12B has a plurality of (for example, seven) teeth extending spirally. In the present embodiment, the tooth sections 21B and 22B are the same in tooth shape and radial size in a radial section. An intermediate shaft section 23B is connected between the tooth section 21B of the front-stage female rotor 11B and the tooth section 22B of the rear-stage female rotor 12B, an outside shaft section 24B is connected to an outer side (the left side in FIGS. 2 and 3) of the tooth section 21B, and an outside shaft section 25B is connected to an outer side (the right side in FIGS. 2 and 3) of the tooth section 22B. The front-stage female rotor 11B and the rear-stage female rotor 12B are rotatably supported by only a plurality of bearings 26B and 27B which are not disposed between the tooth sections 21B and 22B but are disposed on both outer sides of the tooth sections 21B and 22B.

A tip portion of the outside shaft section 24A of the front-stage male rotor 11A projects from a casing 13, and is provided with a pinion gear 28. Though not illustrated, the pinion gear 28 is connected to a rotary shaft of a motor through, for example, a gear mechanism and a belt mechanism. With a rotational force of the motor transmitted to the front-stage male rotor 11A through the pinion gear 28, the gear mechanism, and the belt mechanism, the front-stage male rotor 11A and the rear-stage male rotor 12A are rotated.

The outside shaft section 25A of the rear-stage male rotor 12A and the outside shaft section 25B of the rear-stage female rotor 12B are provided with timing gears 29A and 29B, respectively, and the timing gears 29A and 29B are meshed with each other. With a rotational force of the rear-stage male rotor 12A transmitted to the rear-stage female rotor 12B through the timing gears 29A and 29B, the rear-stage female rotor 12B and the front-stage female rotor 11B are rotated. As a result, the tooth section 21A of the front-stage male rotor 11A and the tooth section 21B of the front-stage female rotor 11B are rotated in such a manner as to be meshed with each other on a non-contact basis, and the tooth section 22A of the rear-stage male color 12A and the tooth section 22B of the rear-stage female rotor 12B are rotated in such a manner as to be meshed with each other on a non-contact basis.

The casing 13 has a front-stage bore 31, a front-stage intake flow line 32, and a front-stage delivery flow line 33 of the front-stage compressing mechanism 1. The front-stage bore 31 is formed in the main casing 15, accommodates the tooth section 21A of the front-stage male rotor 11A and the tooth section 21B of the front-stage female rotor 11B, and forms front-stage operating chambers at tooth grooves of the tooth sections 21A and 21B. The front-stage intake flow line 32 is formed in the front-stage intake-side casing 14 and the front-stage main casing 15, and is a flow line for taking in air into the front-stage operating chambers. The front-stage delivery flow line 33 is a flow line formed in the front-stage main casing 15 and the intermediate casing 16B, and is a flow line for delivering compressed air from the front-stage operating chambers.

The front-stage operating chamber varies in the internal volume thereof while moving from one side (the left side in FIGS. 2 and 3) of the rotor axial direction to the other side (the right side in FIGS. 2 and 3). As a result, the front-stage operating chamber sequentially performs an intake step of taking in air from the front-stage intake flow line 32, a compression step of compressing air, and a delivery step of delivering compressed air to the front-stage delivery flow line 33.

The front-stage delivery flow line 33 communicates with the front-stage operating chambers in the rotor radial direction, and communicates with the front-stage operating chambers in the rotor axial direction through an axial delivery pocket 34. The axial delivery pocket 34 is a flow line which is a part of the front-stage delivery flow line 33, is located so as to overlap with the front-stage bore 31 as viewed in the rotor axial direction, and communicates with the front-stage operating chambers in the rotor axial direction through an axial delivery port 35 (see FIG. 4).

An air seal 51A and an oil seal 52A are provided on an outer circumferential side (specifically, between the front-stage operating chambers and the bearing 26A) of the outside shaft section 24A of the front-stage male rotor 11A. An air seal 51B and an oil seal 52B are provided on an outer circumferential side (specifically, between the front-stage operating chambers and the bearing 26B) of the outside shaft section 24B of the front-stage female rotor 11B. The air seals 51A and 51B restrain air from leaking out of the front-stage operating chambers, while the oil seals 52A and 52B restrain a lubricating oil from leaking from the bearings 26A and 26B.

The casing 13 has a rear-stage bore 36, a rear-stage intake flow line 37, and a rear-stage delivery flow line 38 of the rear-stage compressing mechanism 2. The rear-stage bore 36 is formed in the rear-stage main casing 17, accommodates the tooth section 22A of the rear-stage male rotor 12A and the tooth section 22B of the rear-stage female rotor 12B, and forms rear-stage operating chambers at tooth grooves of the tool sections 22A and 22B. The rear-stage intake flow line 37 is formed in the intermediate casings 16A and 16B and the rear-stage main casing 17, and is a flow line for taking in air into the rear-stage operating chambers. The rear-stage delivery flow line 38 is formed in the rear-stage main casing 17, and is a flow line for delivering compressed air from the rear-stage operating chambers.

The rear-stage operating chamber varies the internal volume thereof while moving from one side (the left side in FIGS. 2 and 4) in the rotor axial direction to the other side (the right side in FIGS. 2 and 3). As a result, the rear-stage operating chamber sequentially performs an intake step of taking in air from the rear-stage intake flow line 37, a compression step of compressing air, and a delivery step of delivering compressed air to the rear-stage delivery flow line 38.

The rear-stage intake flow line 37 communicates with the rear-stage operating chambers only in the rotor axial direction through an axial intake pocket 39. The axial intake pocket 39 is a flow line which is a part of the rear-stage intake flow line 37, is located so as to overlap with the rear-stage bore 36 as viewed in the rotor axial direction, and communicates with the rear-stage operating chambers in the rotor axial direction through an axial intake port 40 (see FIG. 6).

An air seal 53A and an oil seal 54A are provided on an outer circumferential side (specifically, between the rear-stage operating chambers and the bearing 27A) of the outside shaft section 25A of the rear-stage male rotor 12A. An air seal 53B and an oil seal 54B are provided on an outer circumferential side (specifically, between the rear-stage operating chambers and the bearing 27B) of the outside shaft section 25B of the rear-stage female rotor 12B. The air seals 53A and 53B restrain air from leaking out of the rear-stage operating chambers, while the oil seals 54A and 54B restrain a lubricating oil from leaking from the bearings 27A and 27B.

Here, as a large characteristic of the present embodiment, the axial delivery pocket 34 of the front-stage compressing mechanism 1 and the axial intake pocket 39 of the rear-stage compressing mechanism 2 are disposed in a positional relation of partly overlapping with each other in the rotor axial direction, as depicted in FIGS. 3 and 5, and is separated from each other by a separating wall 41, as depicted in FIG. 5. The rotor circumferential directional position of the separating wall 41 is determined on the basis of the shape of the axial delivery port 35, the shape of the axial intake port 40, and the ratio between the delivery flow rate of the front-stage compressing mechanism 1 and the intake flow rate of the rear-stage compressing mechanism 2.

The shape of the axial delivery port 35 is determined on the basis of the sectional shape of the tooth section 21A of the front-stage male rotor 11A and the sectional shape of the tooth section 21B of the front-stage female rotor 11B, and the structure of the axial delivery pocket 34 is determined on the basis of the shape of the axial delivery port 35. In the present embodiment, the axial delivery pocket 34 is formed such that the rotor radial section gradually increases in going in the rotor axial direction (toward the right side in FIG. 3) from the axial delivery port 35; however, the axial delivery pocket 34 may be formed such that the rotor radial section does not vary.

The shape of the axial intake port 40 is determined on the basis of the sectional shape of the tooth section 22A of the rear-stage male rotor 12A and the sectional shape of the tooth section 22B of the rear-stage female rotor 12B. The structure of the axial intake pocket 39 is determined on the basis of the shape of the axial intake port 40. In the present embodiment, the axial intake port 40 has a part overlapping with the axial delivery pocket 34 and the separating wall 41 as viewed in the rotor axial direction. Therefore, a part 39*a* (see FIG. 6) of the axial intake pocket 39 corresponding to a part of the axial intake port 40 is shorter in the length in the rotor axial direction than the other parts (see FIGS. 5 and 6) of the axial intake pocket 39 corresponding to the other parts of the axial intake port 40.

In the present embodiment as aforementioned, the axial delivery pocket 34 of the front-stage compressing mechanism 1 and the axial intake pocket 39 of the rear-stage compressing mechanism 2 are arranged in a positional relation of partially overlapping with each other in the rotor axial direction, whereby the intermediate shaft sections 23A and 23B can be made shorter, as compared to the case where the pockets 34 and 39 are arranged in a positional relation of not overlapping with each other in the rotor axial direction. Therefore, sag and vibration of the rotors can be restrained. In addition, a reduction in the size of the compressor main body 10 can be realized.

In addition, in the present embodiment, a bearing for supporting the intermediate shaft section 23A between the tooth section 21A of the front-stage male rotor 11A and the tooth section 22A of the rear-stage male rotor 12A is eliminated, and a bearing for supporting the intermediate shaft section 23B between the tooth section 21B of the front-stage female rotor 11B and the tooth section 22B of the rear-stage female rotor 12B is eliminated, so that bearing loss (mechanical loss) can be reduced. This effect becomes conspicuous in an oilless type compressor, since the oilless type compressor is rotated at high speed for restraining leakage of air from the operating chambers.

Besides, in the present embodiment, the front-stage delivery flow line 33 of the front-stage compressing mechanism 1 communicates with the front-stage operating chambers in the rotor radial direction, and communicates with the front-stage operating chambers in the rotor axial direction through the axial delivery pocket 34. Therefore, an effect to increase the delivery flow rate and an effect to restrain pressure loss can be obtained. It is to be noted, however, that if a sufficient delivery flow rate can be secured, the front-stage delivery flow line 33 may communicate with the front-stage operating chambers through the axial delivery pocket 34 only in the rotor axial direction.

Figure 7:
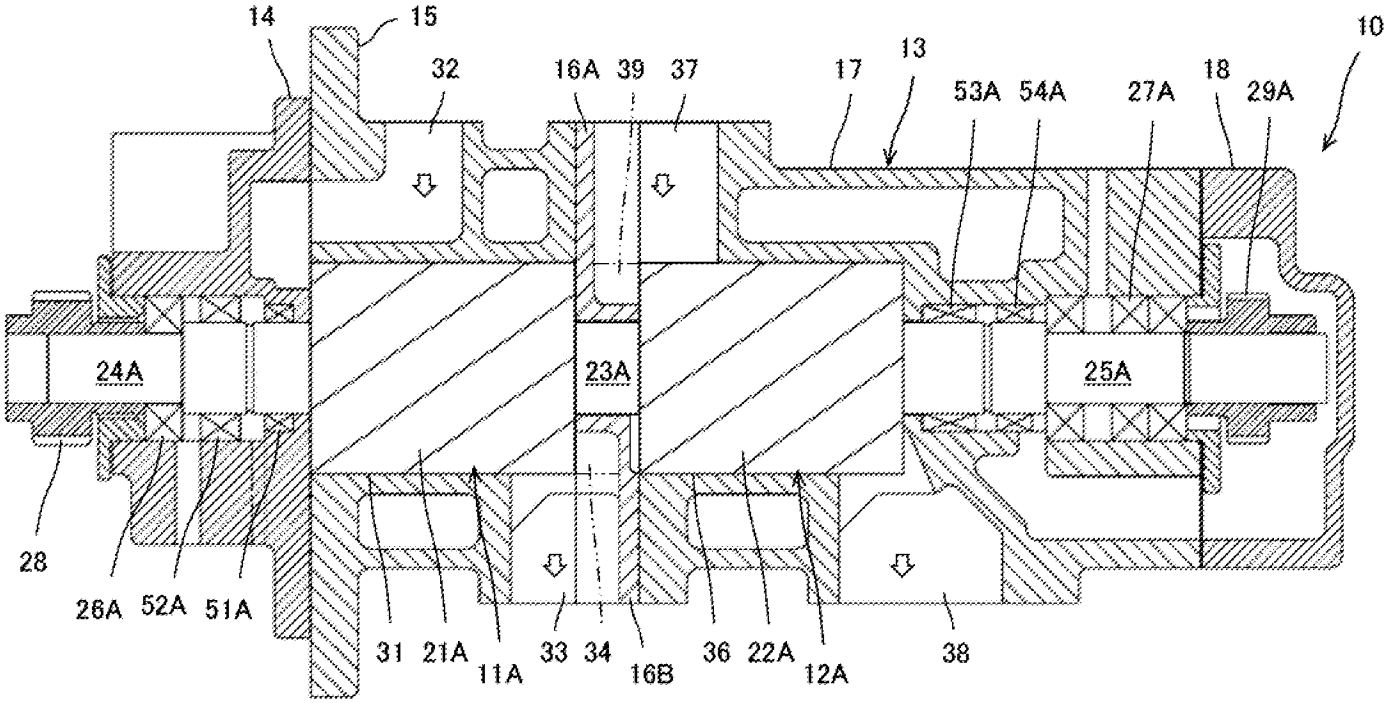
FIG. 7 is a vertical sectional view depicting the structure of a major part of a two-stage screw compressor according to a modification of the present invention.

Note that a case where the rear-stage intake flow line 37 of the rear-stage compressing mechanism 2 communicates with the rear-stage operating chambers through the axial intake pocket 39 only in the rotor axial direction has been taken as an example in describing the aforementioned embodiment, but this is not limitative, and modifications are possible within such a range as not to depart from the gist and technical thought of the present invention. For example, as depicted in FIG. 7, the rear-stage intake flow line 37 may communicate with the rear-stage operating chambers in the rotor radial direction and may communicate with the rear-stage operating chambers in the rotor axial direction through the axial intake pocket 39. In such a modification, the intake flow rate of the rear-stage compressing mechanism 2 can be increased.

Figure 8:
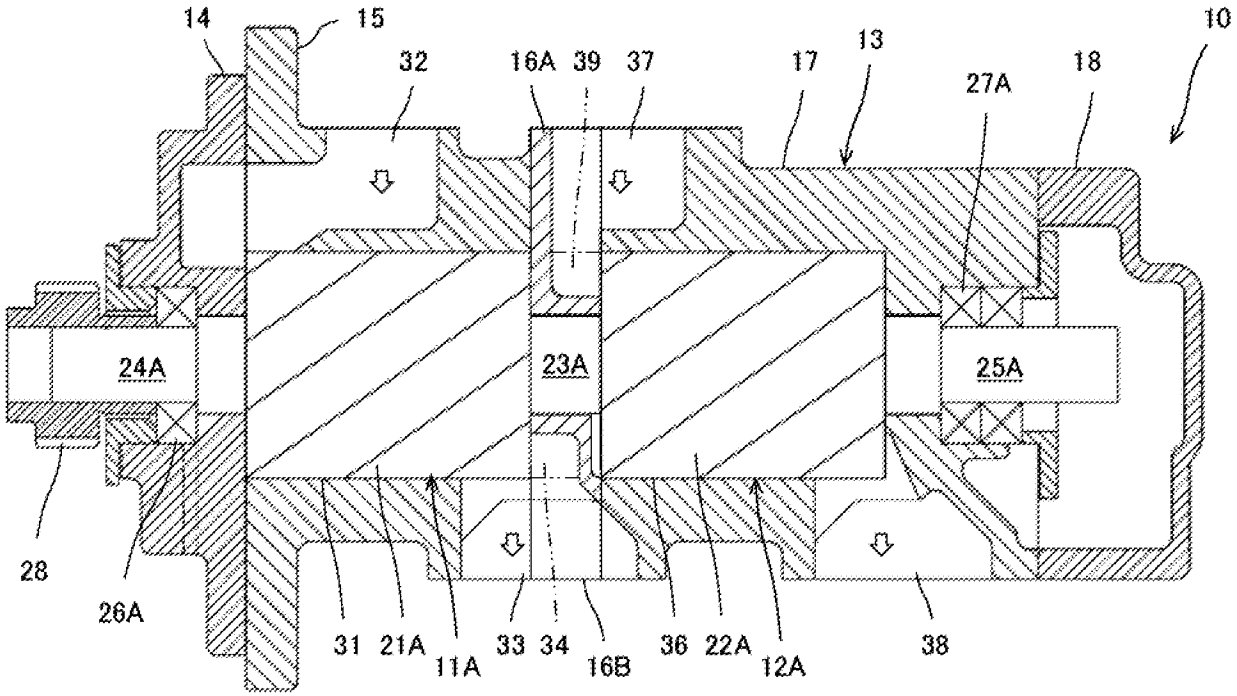
FIG. 8 is a vertical sectional view depicting the structure of a major part of a two-stage screw compressor according to another modification of the present invention.

In addition, an oilless (specifically, an oil is not supplied to the front-stage operating chambers and the rear-stage operating chambers) two-stage screw compressor has been taken as an example in describing the aforementioned embodiment, but this is not limitative, and modifications are possible within such a range as not to depart from the gist and technical thought of the present invention. For example, as depicted in FIG. 8, the present invention may be applied to an oil-lubricated (specifically, an oil is supplied to the front-stage operating chambers and the rear-stage operating chambers, whereby an effect to cool the compressed air and the like is obtained) two-stage screw compressor. In such a modification, the timing gears 29A and 29B, the air seals 52A, 51B, 53A and 53B, and the oil seals 52A, 52B, 54A, and 54B are made unnecessary. In addition, the intercooler 3 may not be provided, unless the temperature of the compressed air delivered from the front-stage compressing mechanism 1 is not sufficiently raised.

Besides, the present invention may be applied, for example, to a three or more-stage screw compressor (namely, a screw compressor including a three or more stage compressing mechanism, in which three or more-stage male rotors are configured to be coaxial, and three or more-stage female rotors are configured to be coaxial). In this case, it is sufficient to apply the characteristics of the present invention to at least two stages of compressing mechanisms.

DESCRIPTION OF REFERENCE CHARACTERS

1: Front-stage compressing mechanism
2: Rear-stage compressing mechanism
3: Intercooler
11A: Front-stage male rotor
11B: Front-stage female rotor
12A: Rear-stage male rotor
12B: Rear-stage female rotor
21A, 21B, 22A, 22B: Tooth section
26A, 26B, 27A, 27B: Bearing
31: Front-stage bore
33: Front-stage delivery flow line
34: Axial delivery pocket
36: Rear-stage bore
37: Rear-stage intake flow line
39: Axial intake pocket
41: Separating wall

The invention claimed is:

1. A multi-stage screw compressor comprising:

a front-stage compressing mechanism that has a front-stage male rotor having a tooth section and a front-stage female rotor having a tooth section, the tooth sections meshing with each other, and a front-stage bore accommodating the tooth section of the front-stage male rotor and the tooth section of the front-stage female rotor and forming front-stage operating chambers at tooth grooves of the tooth sections, the front-stage compressing mechanism compressing a gas by the front-stage operating chambers;

a rear-stage compressing mechanism that has a rear-stage male rotor having a tooth section and a rear-stage female rotor having a tooth section, the tooth sections meshing with each other, and a rear-stage bore accommodating the tooth section of the rear-stage male rotor and the tooth section of the rear-stage female rotor and forming rear-stage operating chambers at tooth grooves of the tooth sections, the rear-stage compressing mechanism further compressing by the rear-stage operating chambers the gas compressed by the front-stage compressing mechanism; and a casing configured to house the front-stage compressing mechanism and the rear-stage compressing mechanism, wherein the front-stage male rotor and the rear-stage male rotor are configured to be coaxial, and rotatably supported by only a plurality of bearings that are not disposed between the tooth sections of the front-stage male rotor and the rear-stage male rotor but are disposed on both outer sides of the tooth sections, the front-stage female rotor and the rear-stage female rotor are configured to be coaxial, and rotatably supported by only a plurality of bearings that are not disposed between the tooth sections of the front-stage female rotor and the rear-stage female rotor but are disposed on both outer sides of the tooth sections, wherein the front-stage compressing mechanism has an axial delivery pocket that is a part of a front-stage delivery flow line for delivering the compressed gas from the front-stage operating chambers, is located so as to overlap with the front-stage bore as viewed in a rotor axial direction and is a flow line communicating with the front-stage operating chambers in the rotor axial direction, the rear-stage compressing mechanism has an axial intake pocket that is a part of a rear-stage intake flow line for taking in the compressed gas into the rear-stage operating chambers, is located so as to overlap with the rear-stage bore as viewed in the rotor axial direction and is a flow line communicating with the rear-stage operating chambers in the rotor axial direction, the axial delivery pocket of the front-stage compressing mechanism and the axial intake pocket of the rear-stage compressing mechanism are disposed in a positional relation of partly overlapping with each other in the rotor axial direction and are separated from each other by a separating wall, the casing includes a front-stage intake-side casing, a front-stage main casing, intermediate casings, a rear-stage main casing, and an end cover, which are partitioned in the rotor axial direction, the intermediate casings are partitioned in the vertical direction, and the rear-stage intake flow line is: i) formed in the intermediate casings and the rear-stage main casing, and ii) configured to take in air into the rear-stage operating chambers.

2. The multi-stage screw compressor according to claim 1, comprising:

an intercooler that cools the compressed gas delivered from the front-stage compressing mechanism, wherein the rear-stage compressing mechanism further compresses the compressed gas cooled by the intercooler.

3. The multi-stage screw compressor according to claim 1, wherein the front-stage delivery flow line of the front-stage compressing mechanism communicates with the front-stage operating chambers in the rotor radial direction, and communicates with the front-stage operating chambers in the rotor axial direction through the axial delivery pocket.

4. The multi-stage screw compressor according to claim 1, wherein the rear-stage intake flow line of the rear-stage compressing mechanism communicates with the rear-stage operating chambers in the rotor radial direction, and communicates with the rear-stage operating chambers in the rotor axial direction through the axial intake pocket.

* * * * *